United States Patent [19]

Boeding

[11] Patent Number: 4,957,256

[45] Date of Patent: Sep. 18, 1990

[54] PRICE TAG DISPLAY HOLDER AND SUPPORT ARM

[75] Inventor: Mary B. Boeding, Madison, Wis.

[73] Assignee: Oscar Mayer Foods Corporation, Madison, Wis.

[21] Appl. No.: 445,000

[22] Filed: Dec. 4, 1989

[51] Int. Cl.[5] ..... A47B 96/00

[52] U.S. Cl. ..... 248/225.1; 40/611; 40/642

[58] Field of Search ..... 248/225.1, 220.2, 225.2, 248/227, 247; 40/606, 642, 584, 611, 649, 650; 211/86

[56] References Cited

U.S. PATENT DOCUMENTS

| | | | |
|---|---|---|---|
| 4,583,308 | 4/1986 | Taub | 40/642 X |
| 4,591,057 | 5/1986 | Garfinkle | 248/220.2 X |
| 4,593,824 | 6/1986 | Pfeifer | 40/642 X |
| 4,665,639 | 5/1987 | Fast | 40/584 X |
| 4,671,002 | 6/1987 | Fast | 40/584 X |
| 4,693,024 | 9/1987 | Fast | 40/584 |
| 4,694,595 | 9/1987 | Fast | 40/642 |
| 4,805,861 | 2/1989 | Thalenfeld et al. | 248/225.1 |

*Primary Examiner*—Ramon O. Ramirez

*Attorney, Agent, or Firm*—Joseph T. Harcarik

[57] ABSTRACT

A price tag display holder and support arm device for use with a peg-bar display of peggable packages which are arranged in both vertical and horizontal rows without appreciable spacing between the vertical and horizontal edges of packages in adjacent rows. The device has a strap-like support arm which is upright or on edge in use. The support arm has a proximal end which is connected in cantilever fashion to one of the vertically spaced horizontal peg supports located at the rear of the packages and a distal end on which a price tag display holder is mounted. The support arm is of adjustble length to permit an adjusted length that places the price tag display holder for viewing by a customer looking in the direction of the aisle. The strap-like support arms of the devices are sufficiently thin so as to permit the arms to be squeezed in between packages in adjacent vertical rows. The devices of the invention permit dispensing with the peg pricing bars that separate horizontal rows of packages in conventional peg-bar package display systems and thereby allow more packages to be displayed within the confines of the same overall available area.

21 Claims, 4 Drawing Sheets

PRICE TAG DISPLAY HOLDER AND SUPPORT ARM

FIELD OF THE INVENTION

This invention relates, generally, to innovations and improvements in means for displaying prices and other information relating to products in peggable packages on so-called peg-board or peg-bar displays.

While the invention is not restricted to use in connection with any particular type of packaged products, it will have its greatest current use in connection with peggable packages of food products such as sliced luncheon meats, displayed in supermarkets or other self-service retail outlets. It is well known that display space or shelf space is an important consideration in the marketing of products in supermarkets and other self-service facilities patronized by the general public. In such establishments, the available display space or shelf space is limited and therefore it is important to utilize available space with maximum efficiency.

Maximum utilization of display space is particularly important in connection with peggable packages of food items such as sliced luncheon meats where there may be many varieties of products, even with only one brand involved vying for the available space.

It has been found that the most effective and efficient way of displaying packaged, self-service selectable, products such as sliced luncheon meats in self-service outlets is peg-board or peg-bar displays. In such displays, the packaged products are highly visible and are readily accessible for selection and removal by the shoppers. Heretofore, in such displays it has been the practice to arrange the peggable packages in horizontal rows utilizing the tab-like "header label" at the top of each package to support the packages on the peg-bars. In such displays, it has been a common practice to have the prices of the various products posted in so-called price bars extending over each row of products. In a typical peg-bar or peg-board display, there are four horizontal rows of product displayed with a price bar extending over the top of each horizontal row.

The object of the present invention, generally stated, is the elimination of price bars in connection with peg-bar or peg-board displays of packaged products and the provision of a new and more effective means of displaying prices and other related product information. By elimination of the conventional price bars in accordance with this invention, more efficient and effective use can be made of the overall display space. For example, by eliminating the horizontal price bars in a display that has four horizontal rows of packaged products, it is possible to display a fifth row, thus improving the efficiency of a conventional display by 25 percent.

For a more complete understanding of the nature and scope of the invention reference may be had to the following detailed description of a specific embodiment thereof taken in connection with the accompanying drawings, wherein.

Figure 4:
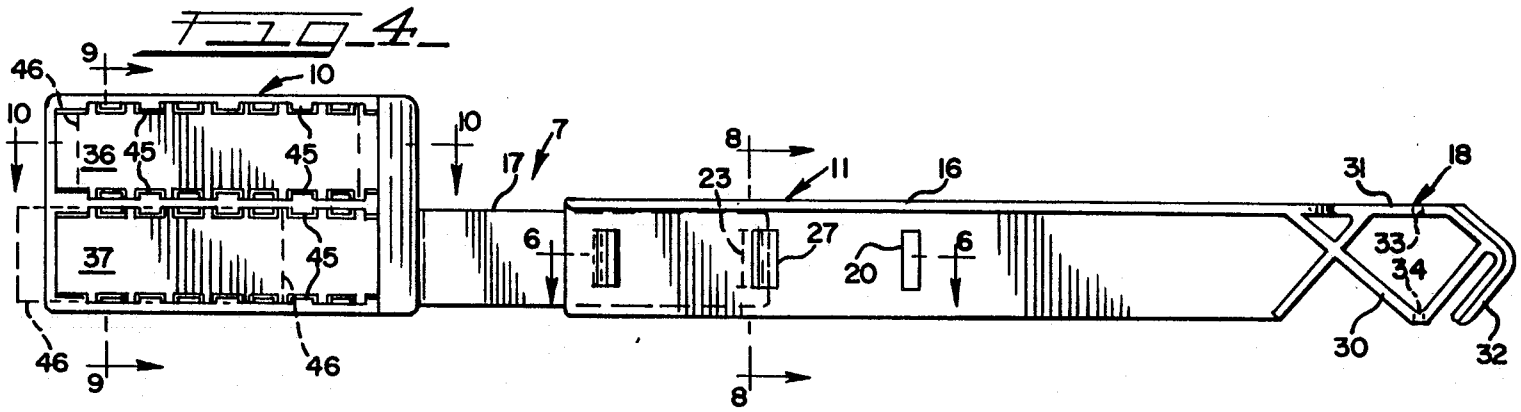
FIG. 4 is a side elevational view of a price tag display holder and support arm device of the present invention and shown in perspective in FIG. 3.
Figure 5:
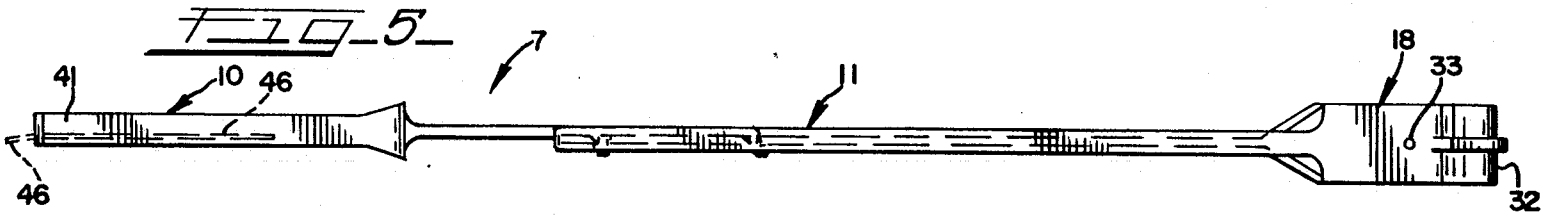
FIG. 5 is a top plan view of the device shown in FIG. 4.
Figure 6:
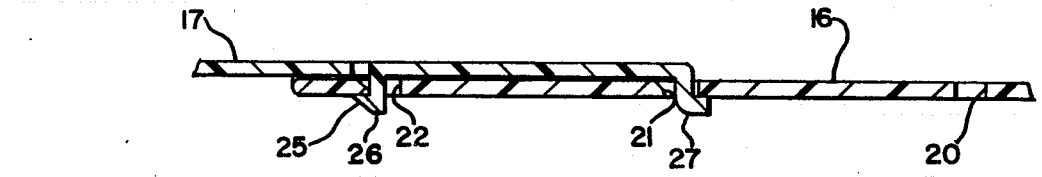
FIG. 6 is a fragmentary sectional view on enlarged Scale taken on line 6—6 of FIG. 4.
Figure 7:
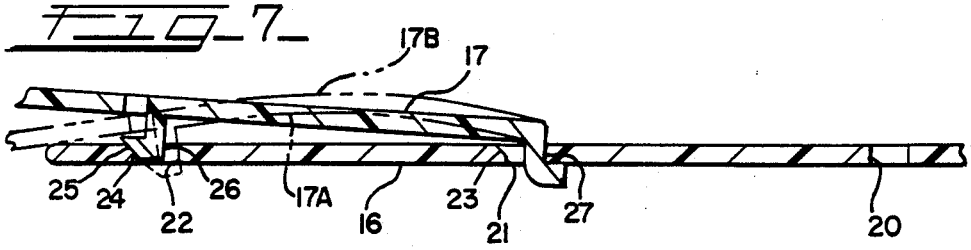
Figure 8:
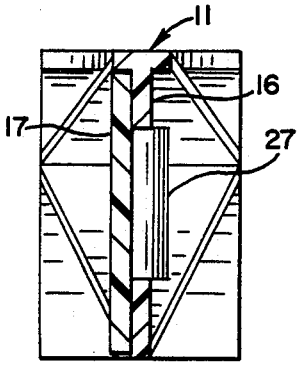
Figure 9:
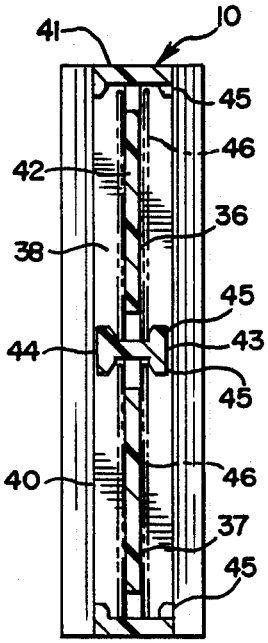
Figure 10:
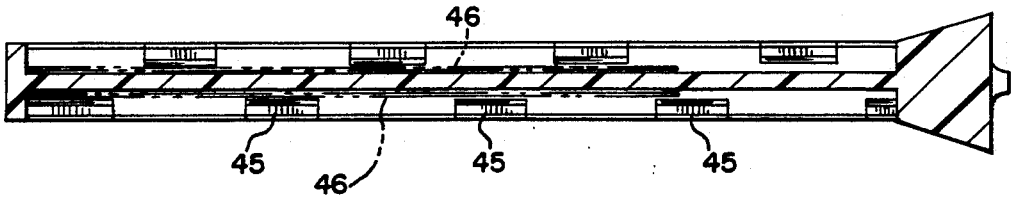

FIG. 7 is a view similar to FIG. 6 but illustrating with the assistance of broken lines the assembly and disassembly of two sections of the device shown in FIGS. 4 and 5; and FIGS. 8, 9 and 10 are detail sectional view taken on lines 8—8, 9—9 and 10—10, respectively, of FIG. 4.

Figure 1:
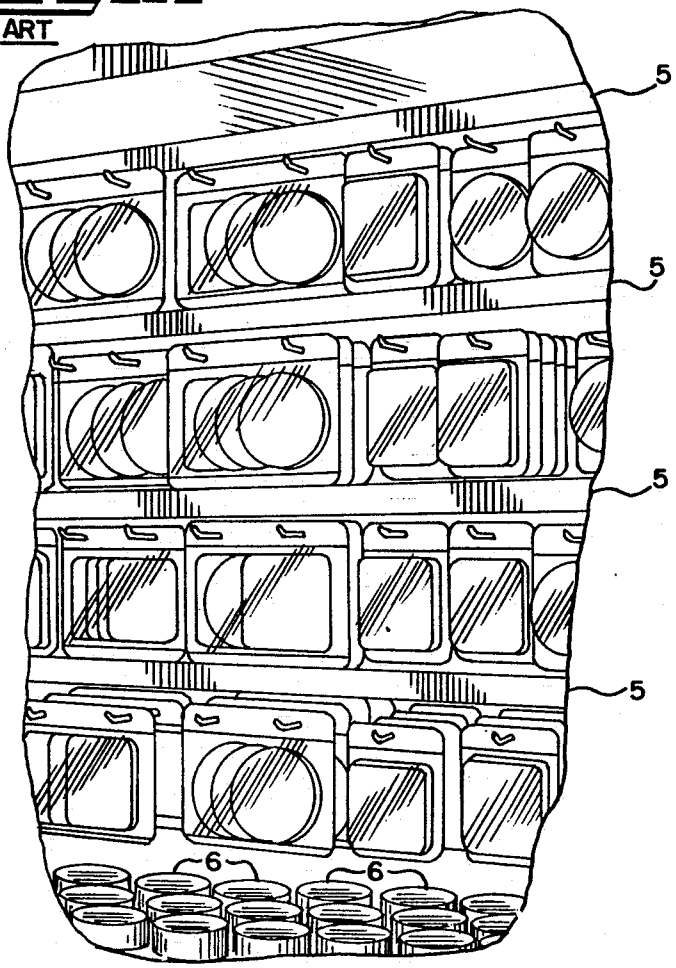
FIG. 1 PRIOR ART
FIG. 1 is a fragmentary perspective view of a conventional prior art peg-bar or peg-board display of sliced luncheon meats.

Referring to FIG. 1, a peg-bar or peg-board display is shown therein wherein four rows of peggable packages of sliced luncheon meats are displayed with a price bar 5 extending over the top of each row. Such a display will ordinarily be positioned as the rear wall of a refrigerator or cold case case where other refrigerated products are displayed on a horizontal shelf as indicated by the packages 6—6.

Figure 2:
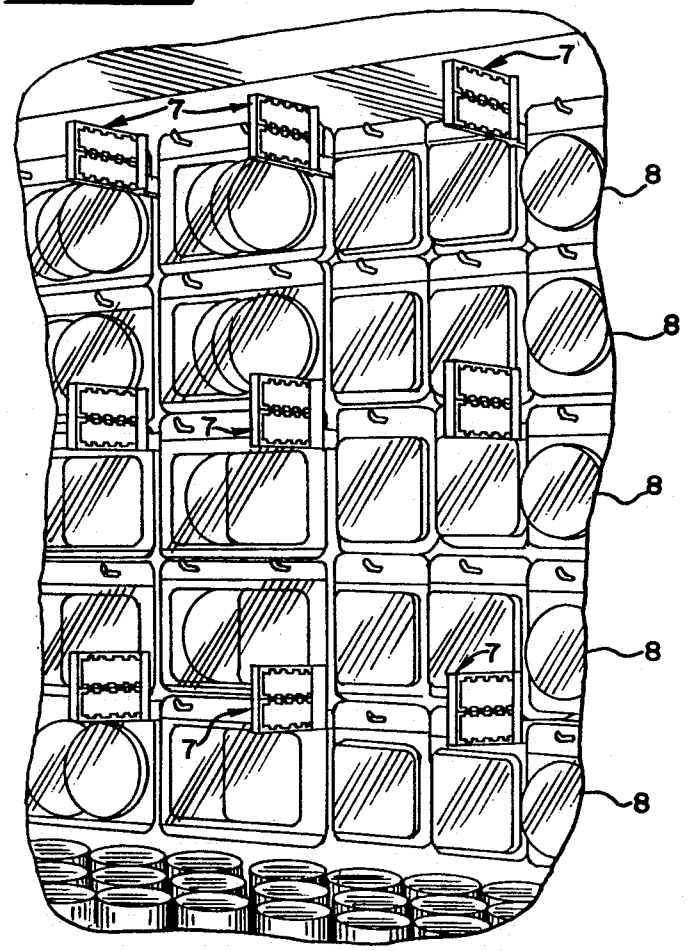
FIG. 2 is a fragmentary perspective view similar to FIG. 1 of a peg-bar or peg-board display of sliced luncheon meats in accordance with the present invention.

In FIG. 2 a peg bar or peg-board display of peggable packages of sliced luncheon meats as shown wherein the pricing information is displayed by means of price tag display holders and support arm devices of the present invention which are indicated generally at 7—7. It will be seen that in FIG. 2 there are five horizontal rows 8—8 of peggable packages of sliced luncheon meats displayed in the same overall space where only four rows 5—5 are displayed in FIG. 1. Thus, the display shown in FIG. 1 has 25 percent more product displayed than is displayed in FIG. 1.

Figure 3:
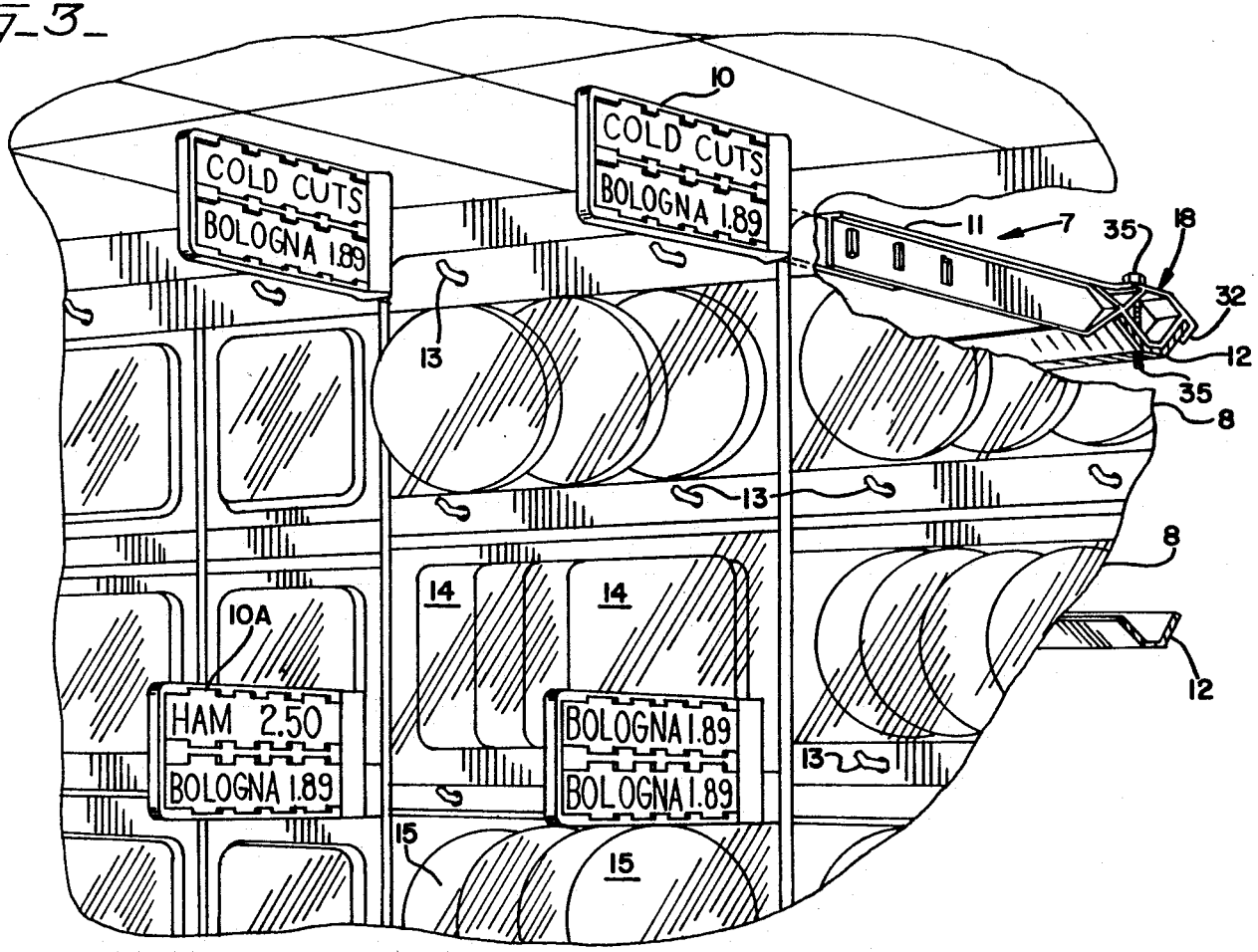
FIG. 3 is a fragmentary perspective view, partly broken away and on enlarged scale of the peg-bar or peg-board display of FIG. 2.

Referring to FIG. 3, a price tag display holder and support arm 7 is shown with the price tag display holder indicated at 10 and the support arm at 11. The device 7 is shown mounted in cantilever fashion on a peg support bar 12 associated with upper row 8 of peggable packages. Peg support bars 12 are conventionally used to support the pegs 13—13 in peg-board displays and typically are in form of V-shaped channels.

Since the front-to-rear depths of packaged product displays such as depicted in FIG. 3 may vary, the support arm 11 of the device 7 is made in two sections whereby its length may be adjusted. The length should be such that the price tag display holder 10 of each device 7 is fully exposed outwardly and in front of the outer most of the packages loaded on the pegs 13.

Each price tag display holder 10 has two pockets on each side so that a total of four different prices can be displayed. The display holders 10 can have more or fewer pockets. Referring specifically to the price tag display holder indicated in FIG. 3 at 10A the price in the upper pocket refers to the packages of ham 14—14 while the price tag in the lower pocket refers to the packages of bologna 15—15. It will be understood that the devices 7 are appropriately located in the overall display in such numbers and positions as to provide the customers with ready identification in relationship to the prices to the various products. Since the price tag display holders 10 project outwardly at right angles to the products displayed, they have greater visibility and can be more easily read than the prices that appear on the horizontal price-bars 5 as shown in FIG. 1.

For a more detailed description of the construction of one of the price tag display holder and support arm devices 7 reference may now be had to FIGS. 4–10. The support arm portion of the device 7 which is indicated generally at 11 in FIGS. 4 and 5, is generally strap-shaped and is formed in two sections 16 and 17. A price tag display holder indicated generally at 10 in FIGS. 4 and 5 is integrally formed and mounted on the distal end of the support arm 11 and section 17. A cantilever mounting formation indicated generally at 18 in FIGS. 4 and 5 is integrally formed on the proximal end of the support arm 11 and section 16 thereof. It will be seen that the support arm section 17 together with the integrally formed price tag display holder 10 form one portion of the device 7 while the support arm section 16 and the integrally formed mounting formation 18 form a second portion thereof.

Referring particularly to FIG. 8, it is shown therein that the support arm section or portion 17 is strap like in cross section and the support arm section 16 is likewise strap like in cross section with a horizontal rib extending along the top thereof so as to give this section greater rigidity against flexing in a horizontal direction. The section 16 has three rectangular openings 20, 21 and 22 therein. These openings have equal widths and lengths and the openings 20 and 22 are equally spaced from the intermediate opening 21. The left hand vertical edges of the openings 21 and 22 are bevelled as indicated at 23 and 24 so as to provide cam surfaces which are cooperative with the cam surface 25 (FIG. 7) on a hook 26 integrally formed on the side of the support arm section 17. A second hook 27 is also formed on the same side of the support arm section 17. It will be seen that the hooks 26 and 27 face in opposite directions. The spacing of the hooks 26 and 27 corresponds to the spacing between the openings 21–22 and 21–20.

When the sections 16 and 17 of the support arm 11 are fully assembled as shown in FIGS. 4–6 they will have formed a rigid arm with little or no play or lost motion between sections 16 and 17. The vertical length or height of the hooks 26 and 27 is such that it permits these hooks to be inserted into respective pairs of openings 22–21 or 21–20 with a minimum of clearance between the tops and bottoms of the hooks and the tops and bottom ends of the openings. The method of assembly and disassembly of the support arm sections 16 and 17 is illustrated in FIG. 7. In assembly the hook 27 is fully inserted into the opening 21 while the cam surface 25 on the hook 26 is brought into camming engagement with the cam surface 24 on the front side of the opening 22. This position of the section 17 relative to section 16 is shown in solid line in FIG. 7 at 17A. In the act of assembling, section 17 is then pressed toward the section 16 and flexes or buckles sufficiently, as indicated in broken line at 17B (FIG. 7) to permit the hook 26 to fully enter and fit under the front edge of the opening 22 as shown in FIG. 6. When thus assembled, the two sections 16 and 17 are firmly locked together.

The sections 16 and 17 can be readily disassembled by inserting the blade of a knife between the sections 16 and 17 intermediate the hooks 26 and 27 so as to bring about a slight flexing or outward bowing of the section 17 as indicated in broken line at 17B in FIG. 7. This flexing permits the hooked portion of the hook 26 to be withdrawn from the front edge of the opening end 22 and permits the relationship shown in solid line in FIG. 7 at 17A to be resumed whereby the two sections can be separated from one another.

It will be seen that the support arm section 17 can be assembled to the support arm section 16 in a second position wherein the hooks 26 and 27 fit into the openings 21 and 20, respectively. The same action in assembly and disassembly occurs in the second relationship as described in connection with FIG. 7. In this way, the length of the support arm 11 is adjustable between two different lengths. By providing additional openings in the support arm section 16, it will be seen that there can be additional adjustments in length as described.

The mounting formation 18 on the proximal end of the support arm 11 is relatively wide and horizontally oriented and has a V-shaped bottom portion 30 (FIG. 4) closed at the top by the bridge portion 31.

While the formation 18 with its hook 32 may alone be an integrally formed bridge portion 31. The angle between the sides of the V-shaped bottom portion 30 is such as to correspond to and nest in the V-shaped peg support bars 12. At the rear, the formation 18 has integrally formed thereon has a downwardly opening hook 32 which is adapted to hook over the rear side of the V-shaped peg support bar 12 as shown in FIG. 3 sufficient to attach or anchor the device 7 to a peg bar support 12 it is preferred to provide apertures or openings 33 and 34 in vertical alignment in the top and bottom portions 31 and 30, respectively, of the formation 18 so as to accommodate a screw 35 (FIG. 3) the lower end of which screws into a threaded hole in the floor of the peg support bar 12. It can be seen that a nut and bolt fastener could also be used in place of the screw fastener 35.

The price tag display holder 10 is a molded formation which has upper and lower pockets 36 and 37 respectively on one side and corresponding pockets 38 and 40 on the opposite side. The holder 10 has a rectangular frame 41 of appreciable width with a vertical divider 42 (FIG. 9). The resulting rectangular pockets on opposite sides of the divider 42 are divided into the upper and lower rectangular pockets 36–37 and 38–40 by horizontal ribs 43 and 44, respectively. The opposing horizontal sides of the pockets 37–40 are provided with inwardly extending projections 45—45 which are spaced from and overhang the bottoms of the pockets provided by the opposite surfaces of the divider 42. These projections 45 serve as retainers for flexible price tags to be inserted and removed from the pockets in the manner indicated at 46 in FIGS. 4 and 5.

While the components of the price tag display holder and support arm devices 7 may be formed of different materials including plastics, metals or wood, from the standpoint of expense, utility and appearance it is preferred to injection mold the same from a suitable plastic material such as high density polyethylene or other plastic.

What is claimed is:

1. A price tag display holder and support arm device in combination with a peg-bar display system for peggable packages includes, a plurality of horizontal, vertically spaced peg support bars, a plurality of horizontal package support pegs projecting at right angles in cantilever fashion from said support bars with the proximal end of each support peg supportably attached to one of said peg support bars and with peggable packages loaded on and removable from said support pegs, each said price tag display holder and support arm device comprising, a support arm mounted in cantilever fashion at its proximal end on one of said peg support bars and projecting therefrom at a right angle thereto and extending outwardly therefrom at least to the distal end of the next adjacent of said support pegs, and a price tag display holder mounted on the distal end of said support arm and extending outwardly therefrom, said peggable packages being loaded on said package support pegs in a plurality of vertically spaced horizontal rows with no appreciable space between the bottoms of said packages in a horizontal row and the tops of said packages in the subjacent horizontal row.

2. In the combination called for in claim 1, said package support pegs being arranged in both horizontal and vertical rows with no appreciable space between the vertical sides of said packages in a row and the vertical sides of the packages in next adjacent vertical row, and with said support arm of each said combined price tag display and support arm device extending between juxtaposed side edges of adjacent packages.

3. In the combination called for in claim 1 said peg support bars being in the form of upwardly open channel members, said proximal end of each said support arm having a formation which interfits into the channel of the peg support bar on which it is supportably attached, and fastener means securing each said proximal end to said peg support bar on which it is supportably attached.

4. In the combination called for in claim 3 each said proximal formation having an integrally formed hook portion which hooks over the rear side of channel member peg support bar to which it is supportably attached.

5. In the combination called for in claim 4 said channel member and said proximal end formations being generally V-shaped.

6. In the combination called for in claim 5 each said V-shaped proximal end formation having a bridge portion interconnecting the top edges of its sides, and said fastener means including a fastener stem extending through vertically aligned apertures in said proximal end portions and said peg support bars.

7. In the combination called for in claim 1 said support arm portion of each said price tag display holder and support arm device being in the form of vertical straps and each said price tag display holder being vertically oriented and integrally attached to the distal end of its said support arm portion and having at least one price tag holding formation on each of its opposite vertical sides.

8. In the combination called for in claim 7 each said support arm portion having multiple longitudinal sections which are detachably interconnectible in at least two different longitudinal relations whereby each said support arm has at least two different lengths in which it may be adjusted.

9. In the combination called for in claim 7 each said price tag support holder having two rectangularly shaped price tag holding formations on each of its opposite vertical sides.

10. A price tag display holder and support arm device for use in combination with an upright peg-bar peggable package display system which includes a plurality of horizontal, vertically spaced peg support bars, a plurality of horizontal package support pegs projecting at right angles in cantilever fashion from said support bars with the proximal end of each said support peg supportably attached to one of said support bars and with peggable packages loaded on and removable from said support pegs with said packages compactly arranged in both horizontal and vertical rows with no appreciable spaces between the adjacent sides tops and bottoms of packages.

each said device comprising a support arm portion and a price tag display holder portion, each said support arm portion being in the form of a vertical strap having a proximal end portion by which it may be supportably attached in cantilever fashion to a said peg support bar, and each said price tag display holder portion being integrally connected to the distal end of said support arm portion and generally co-planar therewith.

11. The price tag display holder and support arm display device of claim 10 wherein said proximal end of said support arm is a generally V-shaped formation that fits in a said peg support bar having a generally V-shaped cross-section.

12. The price tag display holder and support arm device of claim 11 wherein said V-shaped proximal end formation has a hook integrally connected to its rear end which hooks over the rear side of said V-shaped peg support bar.

13. The price tag display holder and support arm device of claim 11 wherein a bridge integrally interconnects the opposite sides of said generally V-shaped proximal end formation and said bridge and the base of said V-shaped proximal end formation have vertically aligned apertures through which the stem of a bolt or screw can extend into or through an aligned aperture in the base of a said V-shaped peg support bar.

14. The price tag display holder and support arm device of claim 11 wherein said price tag holder portion is rectangular in outline with at least one rectangular price tag retaining formation on each opposite side thereof, and each said rectangular price tag retaining formation having at least one row of integrally formed projections under which a semi-rigid price tag may be inserted and from under which a semi-rigid price tag may be removed.

15. The price tag display holder and support arm device of claim 14 wherein each said rectangular price tag retaining formation is in the form of a shallow pocket with opposing rows of said price tag retaining projections on two opposing sides of said pockets spaced from the floor of said pocket.

16. The price tag display holder and support arm device of claim 10 wherein said support am has at least two interconnectible and disconnectible sections with retaining means for releasably interconnecting said sections in at least two different longitudinal positions whereby the length of said support arm may be lengthened and shortened.

17. The price tag display holder and support arm device of claim 16 wherein retaining means for releasably interconnecting said support arm sections comprise at least three longitudinally spaced openings in one of said sections and a pair of integrally formed laterally projecting hooks on the other section spaced and formed to releasably lock into any pair of said spaced openings which are adjacent to one another.

18. The price tag display holder and support arm of claim 17 wherein said longitudinally spaced openings are rectangular and oriented with their length at right angles to the length of said support arm portion, and said hooks are insertable into said spaced openings with their length only slightly less than the length of said openings so as to prevent said support arm sections from being misaligned when interconnected.

19. The price tag display holder and support arm device of claim 18 wherein said hooks face in opposite directions to resist accidental separation of said support arm sections when they are interconnected.

20. The price tag display holder and support arm device of claim 19 wherein said support arm section having said hooks is formed of a semi-rigid material which permits said interconnected sections can be pried apart.

21. The price tage display holder and support arm device of claim 19 wherein two adjacent of said three longitudinally spaced openings have beveled edges on their corresponding vertical edges and the one of said hooks which is insertable in said two adjacent openings has an exposed beveled surface which cams against one of said beveled edges when said support arm sections are assembled.

* * * * *